US008028419B2

(12) United States Patent
VanHoy

(10) Patent No.: US 8,028,419 B2
(45) Date of Patent: Oct. 4, 2011

(54) FOLDING KNIFE OR TOOL

(75) Inventor: Edward Tate VanHoy, Abingdon, VA (US)

(73) Assignee: GB II Corporation, Tualatin, OR (US)

( * ) Notice: Subject to any disclaimer, the term of this patent is extended or adjusted under 35 U.S.C. 154(b) by 210 days.

(21) Appl. No.: 11/435,466

(22) Filed: May 16, 2006

(65) Prior Publication Data

US 2006/0260138 A1 Nov. 23, 2006

Related U.S. Application Data

(60) Provisional application No. 60/683,504, filed on May 19, 2005.

(51) Int. Cl.
*B26B 1/04* (2006.01)

(52) U.S. Cl. ..... 30/161; 30/155; 7/118

(58) Field of Classification Search ..... 30/143, 30/151–161, 252–255; 7/118–120; 81/421, 81/423

See application file for complete search history.

(56) References Cited

U.S. PATENT DOCUMENTS 631,403 A * 8/1899 Metcalf ..... 30/146
837,370 A * 12/1906 Yeaton ..... 30/293
4,502,219 A 3/1985 Hibben
4,805,305 A * 2/1989 Davis ..... 30/258
5,661,908 A * 9/1997 Chen ..... 30/125
5,722,171 A * 3/1998 Schmidt ..... 30/255
6,088,861 A * 7/2000 Sessions et al. ..... 7/128
6,711,820 B2 * 3/2004 Chen ..... 30/122
6,877,229 B2 * 4/2005 Sakai ..... 30/146
7,249,390 B2 * 7/2007 Yale et al. ..... 7/128
2002/0029426 A1 * 3/2002 Seber et al. ..... 7/128
2003/0037644 A1 * 2/2003 Rivera ..... 81/440

OTHER PUBLICATIONS

Haskew, Mike, "Know When to Fold'Em," in *Blade*, Mar. 2006, p. 32-37.

* cited by examiner

*Primary Examiner* — Phong H Nguyen
(74) *Attorney, Agent, or Firm* — Klarquist Sparkman, LLP

(57) ABSTRACT

In one embodiment, a folding knife comprises a handle portion and first and second nesting blades pivotally coupled to the handle portion for pivoting movement between respective open and closed positions. The second blade in one embodiment is formed with a recess or notch which is sized and shaped to receive the first blade, allowing both blades to pivot within a common plane. The knife can also include a locking mechanism that is operable to retain the blades against pivoting movement when the blades are in their respective open positions. In particular configurations, the locking mechanism comprises a resilient locking arm configured to lock both blades in their open positions or first blade alone in its respective locking position. In certain embodiments, a folding tool comprises plural nesting tool elements other than knife blades.

18 Claims, 8 Drawing Sheets

FOLDING KNIFE OR TOOL

CROSS-REFERENCE TO RELATED APPLICATION

The present application claims the benefit of U.S. Provisional Application No. 60/683,504, filed May 19, 2005, which is incorporated herein by reference.

FIELD

The present invention concerns a folding knife or tool, and more particularly a knife or tool with a plurality of blades or tools.

BACKGROUND

One form of conventional sport or work knives comprises a handle and multiple folding blades, which provide cutting edges of different sizes or textures. In order to accommodate the numerous blades, most folding knives of this type couple the blades to the handle on a common pivot pin or separate pivot pins, with each blade being separately pivotable in its own plane. While this construction allows the knife to present multiple blades for use, the knife must be thick enough to accommodate the thickness of each blade. This can require a knife with a thicker profile than would otherwise be desirable. This is true even though in a typical knife no more than one blade can typically be used at once.

An additional feature of conventional knives is the use of a locking mechanism which makes use of a resilient locking element which extends longitudinally through the knife handle and is spring biased to snap into position adjacent to the hinged end (tang) of the blade when the blade is opened. As long as the locking element is retained in the locked position behind the blade, the locking element prevents the blade from pivoting to the closed position. In some implementations, this type locking mechanism is known as a "liner lock". Liner locks are widely used in the knife industry. Unfortunately, the use of liner locks is believed to have been limited to single blade knives.

Accordingly, there remains much room for improvement in the prior art.

SUMMARY

The present disclosure concerns embodiments of a knife with a plurality of or multiple blades. In one aspect of one or more embodiments, the knife can be implemented with nesting blades which are coupled to a handle at a common pivot axis and which are configured to pivot within a substantially common plane between their respective open and closed positions. In particular embodiments, the blades comprise a first, larger blade, which is formed with a recess opposite its cutting edge that is shaped and sized to receive a second, smaller blade. In use, either the smaller blade, or the combination of the larger and the smaller blade (with the smaller blade disposed in the recess of the larger blade), can be pivoted to their respective open positions.

In another aspect of one or more embodiments, a single locking mechanism can be implemented in the folding knife for selectively locking multiple blades in their respective open positions. The locking mechanism can comprise, for example, a flexible, resilient locking element. When either the smaller blade alone, or the larger and smaller blades in combination, are opened, the locking element can spring into place behind end surfaces of the blade(s), preventing the blade(s) from being moved to their respective closed positions. The locking element can then be laterally moved toward one side of the knife in order to allow for closing movement of the blades. Additionally, when only the smaller blade is pivoted to its open position, the locking element can bear against the larger blade and can be retained in place behind the smaller blade, preventing the smaller blade from being closed.

In one representative embodiment, a folding tool comprises a handle portion and at least first and second tool elements pivotally coupled to the handle portion and which are each operable to pivot relative to the handle portion between a respective open position and a respective closed position. The first tool element can be formed with a recess that can be sized and shaped to receive the second tool element when both tool elements are in their respective open positions.

In another representative embodiment, a folding knife comprises a handle portion and at least a first blade and a second blade. The first and second blades comprise cutting edges and can be pivotally coupled to the handle portion and operable to pivot relative to the handle portion between respective open and closed positions. The first blade can also be configured to cover the cutting edge of the second blade when both blades are in their respective open positions.

In another representative embodiment, a folding tool comprises a handle portion and at least first and second tool elements which can be pivotally coupled to the handle portion at a common pivot axis so as to each be operable to pivot relative to the handle portion between a respective open position and a respective closed position. The folding tool can also comprises locking means for selectively locking the first and second tool elements against pivoting movement from their respective open positions.

In yet another representative embodiment, a folding tool comprises a handle portion and at least first and second tool portions which can be pivotally connected to the handle portion and can each be operable to pivot independently relative to each other and to the handle portion between respective open and closed positions. The folding tool also can comprise a lock mechanism comprising a resilient locking arm that is movable between a locked position and an unlocked position. When the locking arm is in the locked position and the first and second tool portions are in the open position, the locking arm prevents pivoting of both tool portions. When the locking arm is moved to the unlocked position, both tool portions can be pivoted from their open positions to their closed positions.

In another representative embodiment, a folding knife comprises a handle portion and at least a first blade and a second blade that can be pivotally coupled to the handle portion and are operable to pivot between open positions and closed positions about a pivot axis. The first and second blades can also define a substantially common plane in which both blades can pivot independently of each other.

In another representative embodiment, a method of using a folding knife is provided. The knife comprises a handle and first and second blades pivotally coupled to the handle at a common pivot axis. The method comprises pivoting the first and second blades from respective closed positions to respective open positions, with at least a portion of a cutting edge of the second blade being nested within a recess in the first blade when both blades are in their respective open positions.

A method according to another embodiment comprises unnesting a first blade or tool from a second blade or tool by pivoting the first blade or tool relative to the second blade or tool to an open position. The second blade or tool can then be pivoted to an open position to allow the first blade or tool to nest within the second blade or tool.

The foregoing and other objects, features, and advantages of the invention will become more apparent from the following detailed description, which proceeds with reference to the accompanying figures.

DETAILED DESCRIPTION

As used herein, the singular forms "a," "an," and "the" refer to one or more than one, unless the context clearly dictates otherwise.

As used herein, the term "includes" means "comprises." For example, a device that includes or comprises A and B contains A and B but may optionally contain C or other components other than A and B. A device that includes or comprises A or B may contain A or B or A and B, and optionally one or more other components such as C.

Figures 1, 2, 3, 5:
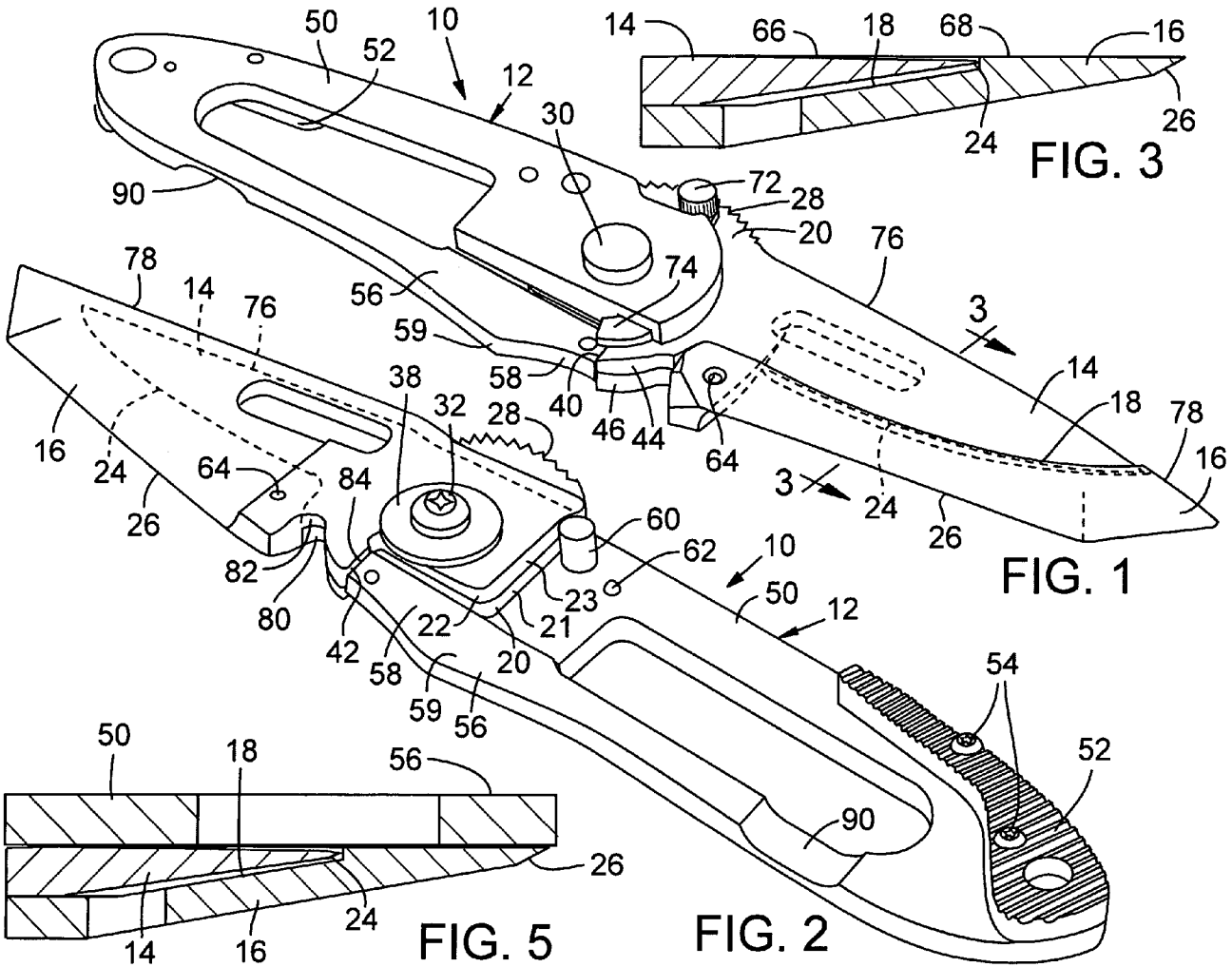
FIG. 1 is a perspective view of a folding knife with first and second nesting blades shown with both blades in their locked, open positions for use, as viewed from one side of the knife, according to one exemplary embodiment.
FIG. 2 is a perspective view of, the folding knife shown in FIG. 1, as viewed from the opposite side of the knife.
FIG. 3 is a cross-sectional view of a portion of the knife of FIG. 1 taken generally along line 3-3 of FIG. 1.
FIG. 5 is a cross-sectional view taken generally along line 5-5 of FIG. 4A.

FIGS. 1-12 illustrate a folding knife 10, according to one embodiment. As best shown in FIGS. 1 and 2, the knife 10 can comprise a handle portion, or handle, 12, a first blade 14 and a second blade 16, which are pivotally coupled to the handle portion. The blades can each be pivoted between respective folded, closed positions, and respective open or use positions. FIGS. 1 and 2 show the knife with the first and second blades in their respective open positions extending from the handle portion. FIGS. 4A and 4B show the knife with the first and second blades in their respective closed positions with the blades extending in an overlapping relationship with the handle portion. FIGS. 7A and 7B show the knife with the first blade 14 in its open position and the second blade 16 in the closed position.

Although the present disclosure describes a folding knife, the embodiments described herein more generally can be folding tools comprising a handle and multiple tool elements that can pivot between respective closed and open positions relative to the handle. The tool elements can be, for example, knife blades, screwdrivers, files, wrenches, pliers, which can be used in any combination. For example, FIG. 16, described further below, shows a folding tool 218 comprising a screwdriver 220 that can nest within a file 222. Various other types of tools elements also can be used.

The handle portion 12 in the illustrated configuration comprises an open frame having a substantially rigid, elongated frame portion 50 and a blade guard 52 which can be connected to the frame portion 50 by screws 54. The blade guard 52 can be sized and shaped to shield a portion of the cutting edge 26 of blade 16 when the blade is in the closed position (as best show in FIG. 4B). The blade guard 52 also can be formed with a series of ridges on its exposed surface as shown in FIG. 2 so as to provide a gripping surface for a user's hand.

The blades 14, 16 have respective tang portions 20, 22 that can be coupled to the frame portion 50 by a pivot assembly comprising, for example, a pivot pin 30 and a pivot screw 32. The forward end of the frame portion 50 can include a laterally extending stud 60, which can engage corresponding surfaces of the blades 14, 16 when they are in their respective open or closed positions.

Figures 7A, 7B:
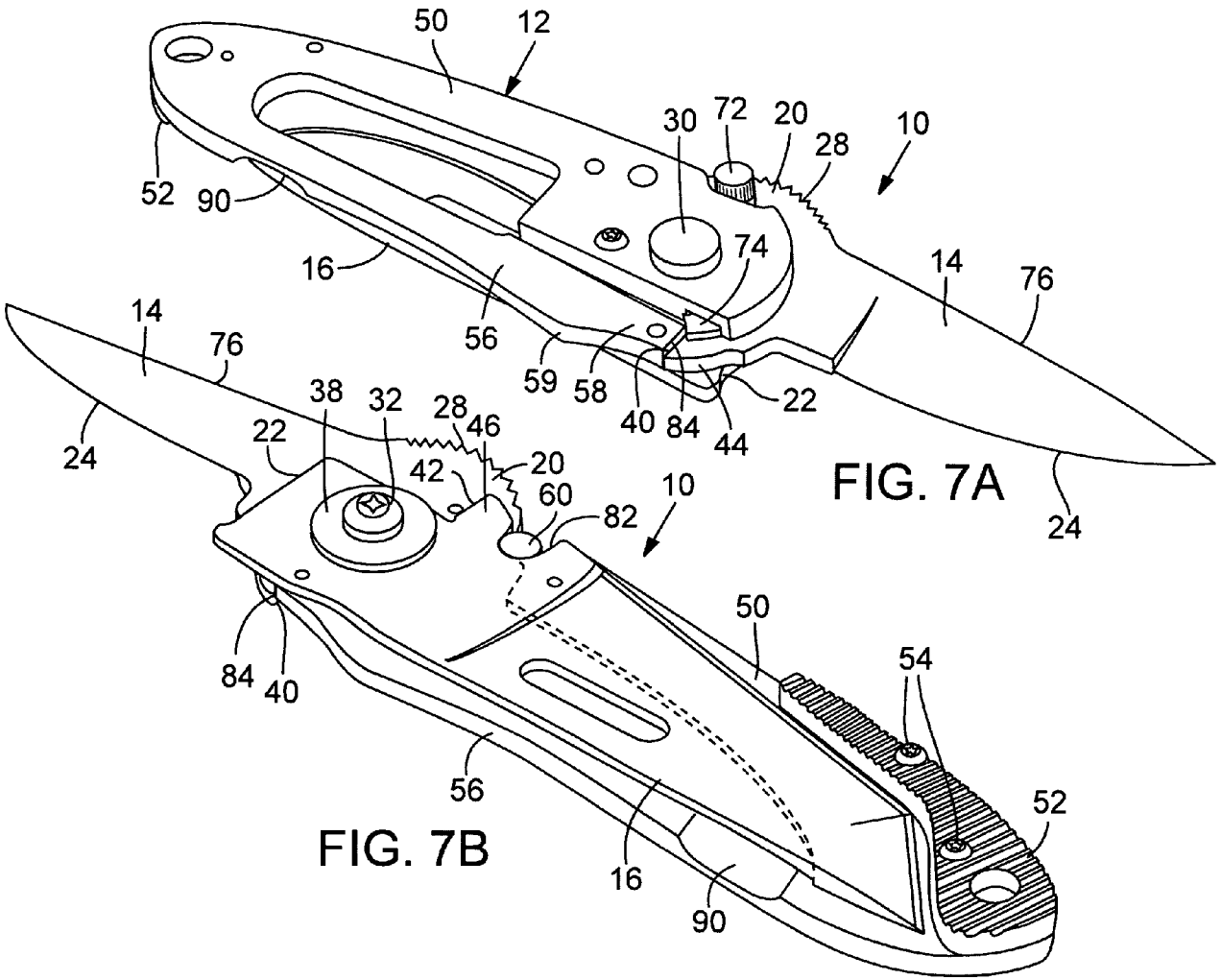
FIG. 7A is a perspective view of the knife of FIG. 1 shown with the smaller blade in its open position and the larger blade in its closed position, as viewed from one side of the knife.
FIG. 7B is a perspective view of the folding knife similar to FIG. 7A, but as viewed from the opposite side of the knife.
Figure 8:
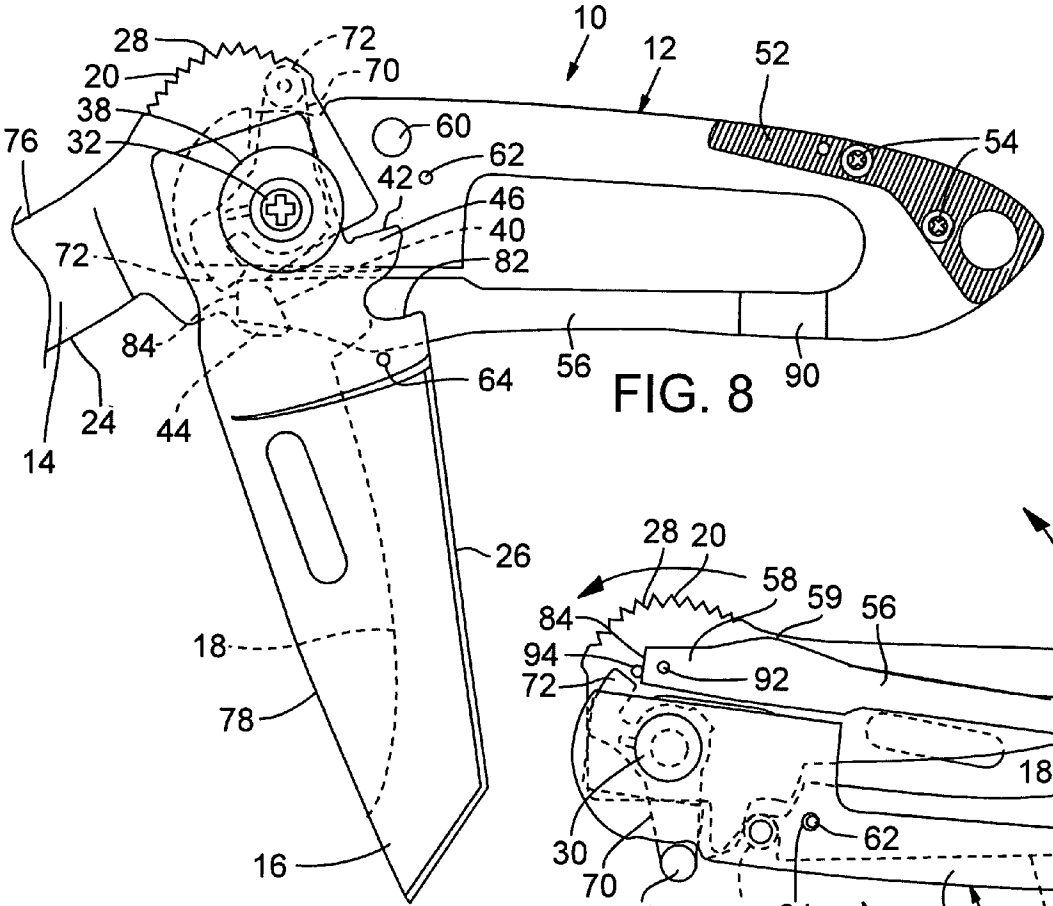
FIG. 8 is a side elevation view of the knife of FIG. 1, showing the blades in different positions between their respective open and closed positions.
Figure 10:
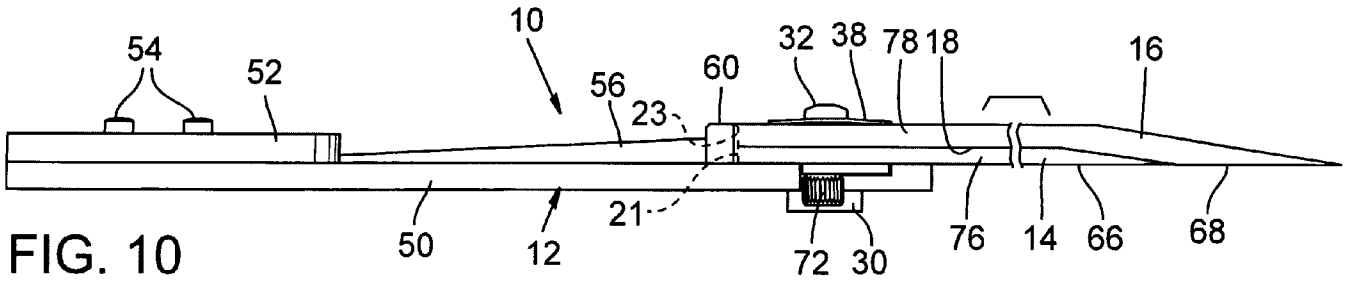
FIG. 10 is a top plan view of the knife of FIG. 1.

In the illustrated embodiment, the second blade 16 is larger in size and shape than the first blade 14 and is formed with a recess, or notch, 18 (as best seen in FIG. 8) which is of a similar size and shape to the first blade 14 such that, when both blades 14, 16 are in their respective open or closed positions, the first blade 14 can nest within the recess 18 of the second blade 16 (FIGS. 1-5). By allowing the first blade 14 to sit within the recess 18 of the second blade 16, both blades define a common plane in which they both can pivot (as best seen in FIG. 10). The recess 18 in the illustrated form is also sized and shaped to cover a cutting edge 24 of the first blade 14. Thus, when both blades are opened in the illustrated example, the cutting edge 26 of the second blade 16 is exposed for use and the cutting edge 24 of the first blade is received in the recess 18. In contrast, when the second blade 16 is pivoted to its closed position and the first blade 14 is in its open position (as shown in FIGS. 7A and 7B), the cutting edge 24 of the first blade 14 is made available for use.

FIGS. 3 and 5 illustrate that the blades 14, 16 define a common pivoting plane within which blades can pivot. As used herein, a common pivoting plane refers to any plane that extends through both blades and is perpendicular to the common pivot axis of the blades. By allowing the blades to pivot within the same pivoting plane, the knife can utilize multiple blades while maintaining a relatively thin profile. In particular embodiments, as best shown in FIGS. 3 and 10, the notch 18 is open to an outer side surface 68 of the second blade and the first blade 14 has an outer side surface 66 that is substantially co-planar to the outer side surface 68 of the second blade 16. Also, in the illustrated example, both side surfaces 66, 68 are generally flat surfaces that extend generally perpendicular to the upper surfaces 76, 78 of the first and second blades 14, 16, respectively. As such, the first blade 14 in the illustrated embodiment pivots completely within the three-dimensional space defined by the second blade 16 as it is pivoted between its closed and open positions. In other embodiments, the blades define common pivot plane but the first blade can have a side surface 66 that extends laterally beyond the side surface 68 of the second blade 16. In another embodiment, the notch or recess 18 is confined within the opposite side surfaces of the second blade 16, that is, the notch does not open to the side surface 68 but is open to the top surface of the second blade 16 to allow the first blade 14 to pivot into the notch.

Because the first blade 14 can nest within the second blade 16, the blades in illustrated embodiment are prevented from pivoting through each other. Advantageously, both blades 14, 16 therefore can be operated in certain situations by manipulation of a single blade. For example, when both blades 14, 16 are in their respective closed positions, pivoting the second blade 16 to its open position also causes the first blade 14 to pivot to its open position. Conversely, when both blades 14, 16 are in their respective open positions, pivoting the first blade 14 to its closed position also pivots the second blade 16 to its closed position.

In the illustrated embodiment, as best shown in FIG. 2, a stop such as a stud 60 is positioned to engage end surfaces 21, 23 of tang portions 20, 22, respectively of the blades to prevent the blades from being pivoted past their respective open positions. The stud 60 in the illustrated embodiment also engage notches 80, 82 in the first and second blades 14, 16, respectively, when the blades are pivoted to their closed positions. Thus, in the illustrated example, the stud 60 functions as a motion-limiting or stop member defining a 180-degree arc for pivoting the blades. In other embodiments, the stud 60 and/or the blades can be configured such that the range of motion of the blades is greater or less than 180 degrees.

The knife also can include a blade locking mechanism for locking the blades in the open position. In the illustrated embodiment, the locking mechanism comprises a flexible, resilient locking arm 56 (also referred to as a leaf spring or locking bar) which is resiliently biased toward the tang portions 20, 22 of the blades 14, 16, respectively. The free end 58 of the locking arm has an end surface 84 that can contact corresponding locking surfaces 40, 42 of the tang portions 20, 22, respectively (as best shown in FIGS. 1 and 2). Referring to FIG. 1, the locking surfaces 40, 42 in the illustrated embodiment are located on projections 44, 46 of tang portions 20, 22, respectively.

Figure 11:
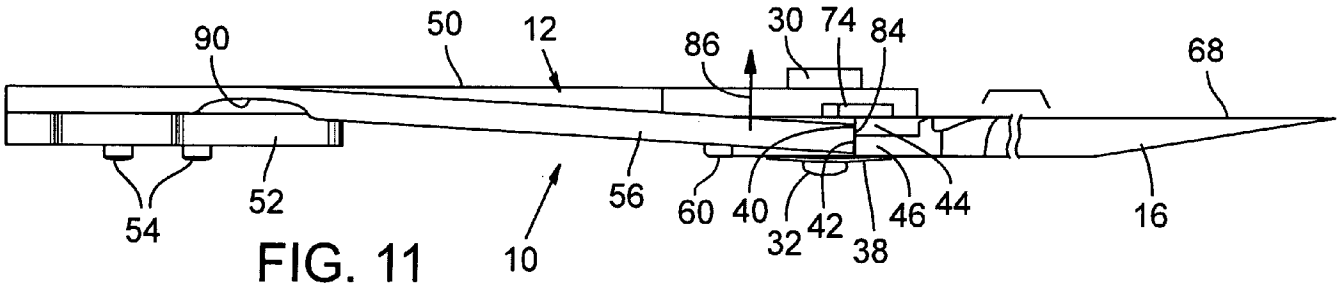
FIG. 11 is a bottom plan view of the knife of FIG. 1.
Figure 12:
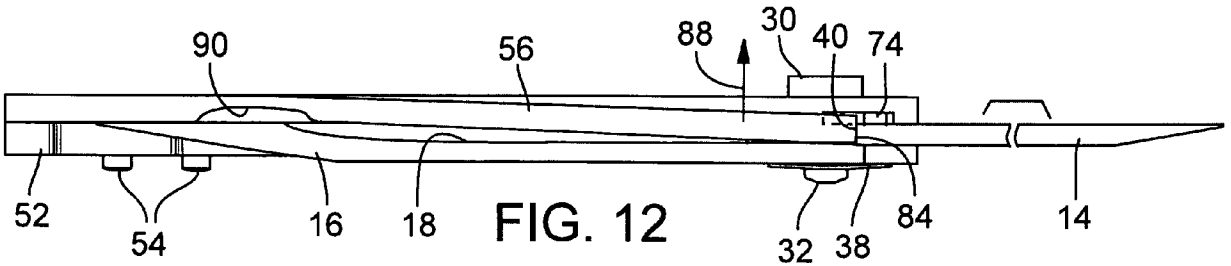
FIG. 12 is a bottom plan view of the knife of FIG. 1, showing the smaller blade in its open position and the larger blade in its closed position.

In the illustrated embodiment, the locking arm 56 and the frame portion 50 comprise a unitary, monolithic body. The body desirably is formed with a notch 90 (as best shown in FIGS. 11 and 12) to facilitate flexing of the locking arm. In an alternative embodiment, the handle portion can comprise first and second side panels with a liner lock having a locking arm disposed between the side panels.

When the first blade 14 and the second blade 16 are pivoted to their respective open positions (as shown in FIGS. 1 and 2), the free end 58 of the locking arm 56 snaps into a first locked position behind and firmly engaging the locking surfaces 40, 42 of the blades. So long as the locking arm 56 is retained in this locked position, the locking arm 56 prevents both blades 14, 16 from pivoting from their respective open positions to their respective closed positions. To return both blades 14, 16 to their respective closed positions at the same time, the locking arm 56 is moved laterally toward the frame portion 50 (in the direction indicated by arrow 86 in FIG. 11) until the free end 58 of the locking arm 56 clears both locking surfaces 40, 42 of the blades, at which point the blades can be pivoted closed. Moving the locking arm 56 can be accomplished by applying a lateral force to a user-engageable portion 59 of the locking arm 56 with a thumb in the direction of arrow 86.

Figure 4A:
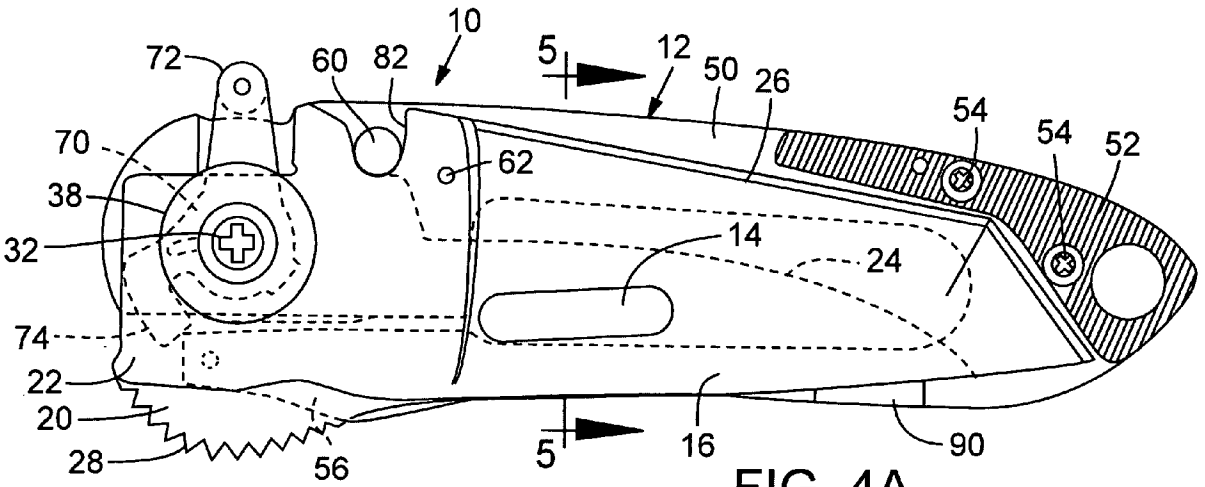
FIG. 4A is side elevation view of the knife of FIG. 1 showing the blades in their respective closed positions.
Figure 4B:
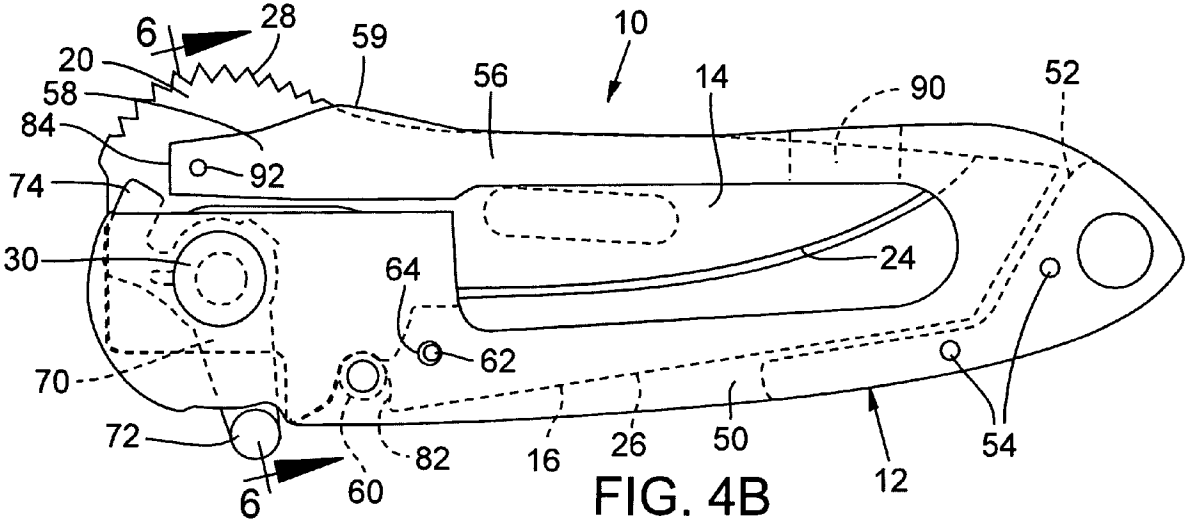
FIG. 4B is an elevation view of the opposite side of the knife from FIG. 4A with the blades shown in their respective closed positions.
Figure 6:
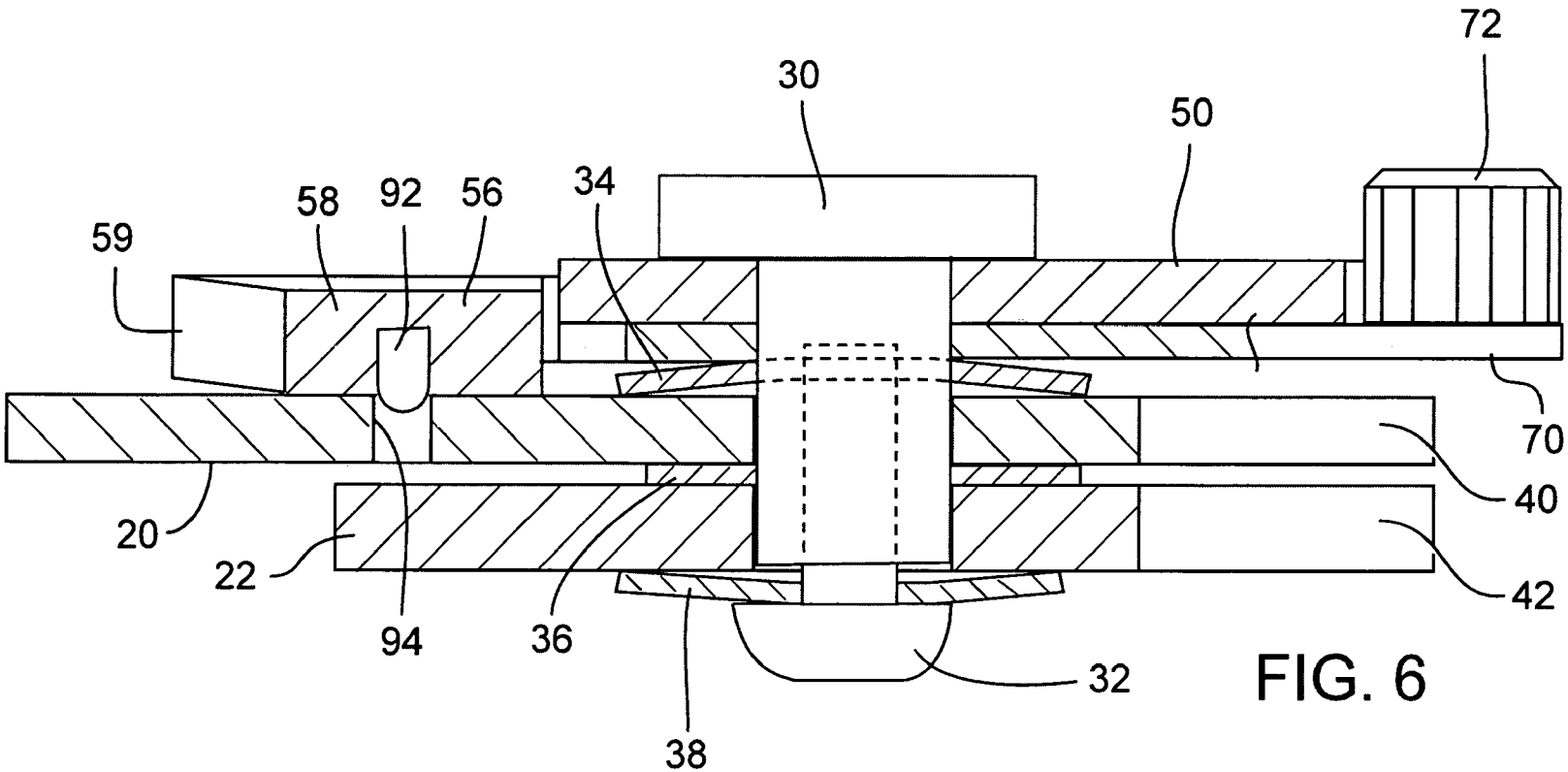
FIG. 6 is a cross-sectional view taken generally along line 6-6 of FIG. 4B.

When the blades 14, 16 are in their respective closed positions (as shown in FIGS. 4A and 4B) the free end 58 of the locking arm 56 bears against the side of the tang portion 20 of the first blade in what can be referred to as an unlocked position. In this position, both blades are free to pivot, although the force of the locking arm 56 against the side of the tang portion 20 assists in preventing the blades from pivoting open under their own weight. As best shown in FIG. 6, the locking arm 56 optionally can be provided with a small laterally extending projection 92 that is received in a detent or opening 94 in the tang portion 20 of the first blade 14 to assist in retaining the first blade closed. Because the second blade 16 in the illustrated embodiment can only be opened with the first blade. 14, the force of the locking arm 56 against the first blade 14 helps retain the second blade in the closed position. The frame portion 50 can include a spring-loaded projection or ball 62 (FIG. 2) that is received in a corresponding detent or opening 64 formed in the second blade 16 to assist in maintaining the second blade 16 in its closed position.

In addition, the illustrated locking arm 56 can be positioned in a second locked position intermediate the first locked position and the unlocked position. This position is achieved when the first blade 14 is in its open position and the second blade 16 is in its closed position. In this position, the locking arm 56 bears against the side of the tang portion 22 of the second blade 16 such that the locking arm 56 is maintained in a locked position behind and in-line with the locking surface 40 of the first blade 14 (as best shown in FIG. 7A). So long as the locking arm 56 is maintained in the second locked position, the first blade 14 is prevented from pivoting from its open position to its closed position. Thus, in the second locked position the locking arm 56 is able to lock the first blade 14 in its open position, presenting the cutting edge 24 of the first blade 14 for use, while the second blade 16 is in its closed position but is free to rotate. If the second blade 16 is then pivoted to its open position, the free end 58 of the locking arm 56 snaps into the first locked position described above, where it is behind the locking surfaces 40, 42, of blades 14, 16, respectively. It is through these three positions, the unlocked position and the two locked positions, that a single locking mechanism is able to lock either a combination of both the first and second blades 14, 16, thus providing the cutting edge 26 of the second blade in a locked position for use, or to lock the first blade 14 alone, providing the cutting edge 24 of the smaller blade 14 for use. This advantageously allows for locked use of either blade 14 or 16 with a single locking mechanism, providing a simpler knife with a thinner profile than if separate locking mechanisms were used for each blade.

If other tool elements such as files, screwdrivers, saws, etc. are used, a similar locking mechanism can be used to engage the end surfaces of the tool elements to lock them in their respective open positions.

In order to secure the locking arm 56 in the first locked position, a safety mechanism 70, or safety lock, can be provided. The safety mechanism is moveable between a safety position in which the locking arm 56 is retained in the first locked position and a release position in which the locking arm 56 can be moved by a user between the locked positions and the unlocked position. The safety mechanism 70, the entirety of which is shown, partially in phantom, in FIGS. 4A and 4B, is disposed between the forward end portion of the frame portion 50 and the tang portion 20 of the first blade 14.

The pivot pin 30 of the pivot assembly can extend through a central opening in the safety mechanism 70 to permit pivoting of the safety mechanism 70 about the pivot axis of both blades.

The safety mechanism 70 can include a user-engageable finger tab 72 for manual engagement of the safety mechanism 70 and an extension portion 74 which projects toward the free end 58 of the locking arm 56. The safety mechanism 70 can be pivoted about pivot pin 30, such as by moving the finger tab 72 in the clockwise or counterclockwise directions. The safety mechanism 70 can be pivoted to the safety position by moving the finger tab 72 to a forward-most position closest to the forward end of the handle portion. The safety mechanism 70 can be pivoted to the release position by moving the finger tab 72 to a rear-most position closest to the rear end of the handle portion.

When the safety mechanism 70 is in the safety position and both blades 14, 16 are in their respective open positions (as best shown in FIGS. 1 and 11), the extension portion 74 is located at a position adjacent a side surface of the free end 58 of the locking arm 56. In this position, the extension portion 74 prevents lateral movement of the locking arm 56 toward the frame portion 50 to the second locked position and the unlocked position, thus protecting against inadvertent closure of the open blades 14, 16. When the finger tab 72 is pivoted to the rear-most position to move the safety mechanism to the release position, the extension portion 74 is moved to a location free of the end surface 84 of the locking arm 56, thereby allowing the locking arm 56 to be moved away from the first locked position to permit closure of the blade(s).

In an alternative embodiment, the safety mechanism 70 can be configured to block movement of the locking arm 56 when the locking arm is in the first locked position and the second locked position. For example, the extension portion 74 can be provided with a stepped surface facing the locking arm 56 and comprising a first surface portion and a second surface portion spaced different distances from the locking arm 56. When both blades are in the open positions, the safety mechanism 70 can be pivoted to place the first surface portion at a location blocking movement of the locking arm 56. When only the first blade 14 is open and the second blade is closed, the safety mechanism can be pivoted to place the second surface portion at a location blocking movement of the locking arm 56, thereby protecting against inadvertent closure of the first blade.

While in the illustrated embodiment the safety mechanism 70 may be freely moved between release and safety positions, in an alternative embodiment, a biasing mechanism (e.g., a spring) can be used to bias the safety mechanism 70 toward its safety position, such as described in U.S. Application Ser. Nos. 60/776,568, filed Feb. 24, 2006, and 60/682,526, filed May 18, 2005, both of which applications are incorporated herein by reference. Thus, in this alternative embodiment, the safety mechanism 70 is maintained in the safety position unless sufficient pressure is applied to the tab portion 72 of the safety mechanism 70 to overcome the biasing force of the spring and rotate the safety mechanism 70 to the release position.

The safety mechanism 70 also can be implemented in embodiments implementing tool elements other than knife blades to protect against inadvertent closure of the tool elements.

FIG. 6 illustrates a cross-sectional view of the knife 10 taken through the pivot assembly (as indicated by line 6-6 in FIG. 4B). As shown, the pivot pin 30 can extend through openings in the frame portion 50, the safety mechanism 70, and the tang portions 20, 22 of the first and second blades 14 and 16, respectively. The pivot pin 30 also can extend through washers 34 and 36 placed on either side of the tang portion 20 of the first blade 14 and a washer 38 placed between the pivot screw 32 and the tang portion 22 of the second blade 16. The pivot screw 32 extends into a threaded opening in the pivot pin 30 and is tightened to a sufficient degree to secure the assembly together but yet allow the blades to pivot relative to each other and the handle portion. Because the pivot screw 32 must be loose enough to permit pivoting of the blades, at least one of the washers 34, 36, 38 desirably comprises a compression washer, for example washers 34, 36 as depicted in the illustrated embodiment. The compression washers 34, 36 exert pressure against the screw 32 and the pivot 30 in the axial direction to assist in retaining the screw 32 in the pivot 30.

Figure 9:
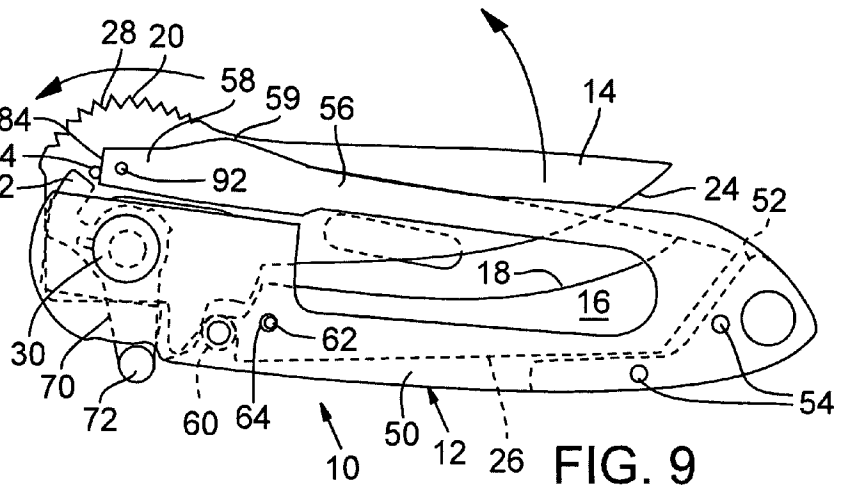
FIG. 9 is a side elevation view of the knife, as in FIG. 4A, but showing the smaller blade of the knife being pivoted away from its closed position.

Referring to FIGS. 1, 7A, 8, and 9, the operation of the knife 10 will now be described. FIG. 8 shows both the first blade 14 and the second blade 16 each pivoted to points intermediate between their respective open and closed positions. Each of the blades 14 and 16 can be separately pivoted between these positions, subject to the constraint in the illustrated embodiment, discussed above, that the blades 14 and 16 cannot pivot past each other. FIG. 9 shows the first blade 14 being pivoted away from its closed position by application of force in the counterclockwise direction in FIG. 9 to an enlarged portion 28 of tang 20. Enlarged portion 28 can be provided with a knurled peripheral surface to provide a gripping surface for opening the first blade 14. The second blade 16 can be moved by application of force to the side of the blade 16, as known in the art. As discussed above, because the second blade 16 and the first blade 14 in the illustrated embodiment cannot pivot past each other, application of force to pivot the second blade 16 toward its open position simultaneously pivots the first blade 14 to its own open position.

If force is applied to enlarged portion 28 to pivot the first blade 14 alone toward its open position, it may be pivoted until it reaches its open position, at which point the locking arm 56 snaps into the second locked position described above, in place behind and in line with the locking surface 40 of the first blade 14, and bearing against the tang portion 22 of the second blade 16. FIG. 7A shows the first blade 14 in its fully extended, open, and locked position. When in this position, a user may use the cutting edge 24 of the first blade 14, and then may optionally return the first blade 14 to its closed position or may pivot the second blade 16 to its own open position. The user may return the first blade 14 to its closed position by applying a lateral force to the locking arm 56 (as indicated by arrow 88 in FIG. 12), moving the locking arm 56 away from the locking surface 40 of the first blade 14 to the unlocked position and then pivoting the first blade 14 back to its closed position.

Alternatively, the user may apply pressure to the side of the second blade 16 to pivot the second blade 16, along with the first blade, toward their open positions. When the blades reach their open positions, the locking arm 56 snaps into place behind the locking surfaces 40, 42 of the blades. With both blades open, the user can move the locking arm 56 in the direction of arrow 86 (FIG. 11) a first distance sufficient to permit closure of the second blade 16 only (which then retains the locking arm in the second locked position (FIG. 12)) or a second distance to the unlocked position to allow closure of both blades simultaneously.

Figure 13:
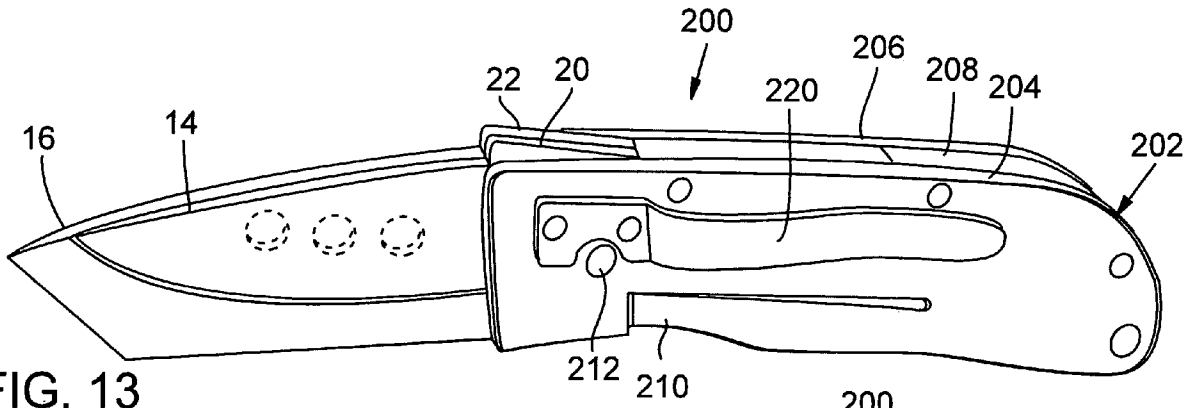
FIG. 13 is a perspective view of a folding knife with first and second nesting blades shown with both blades in their locked, open positions for use, as viewed from one side of the knife, according to another embodiment.
Figure 14:
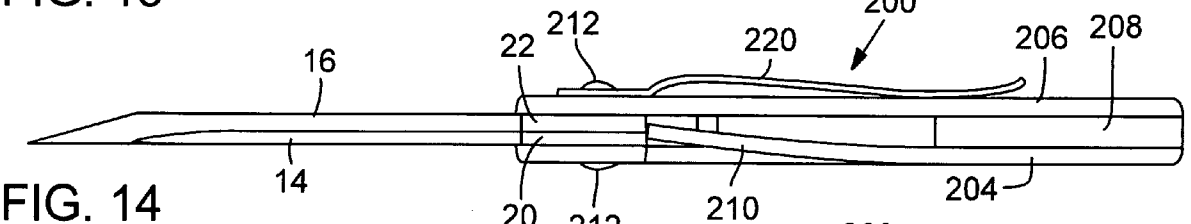
FIG. 14 is a top plan view of the knife of FIG. 13.
Figure 15:
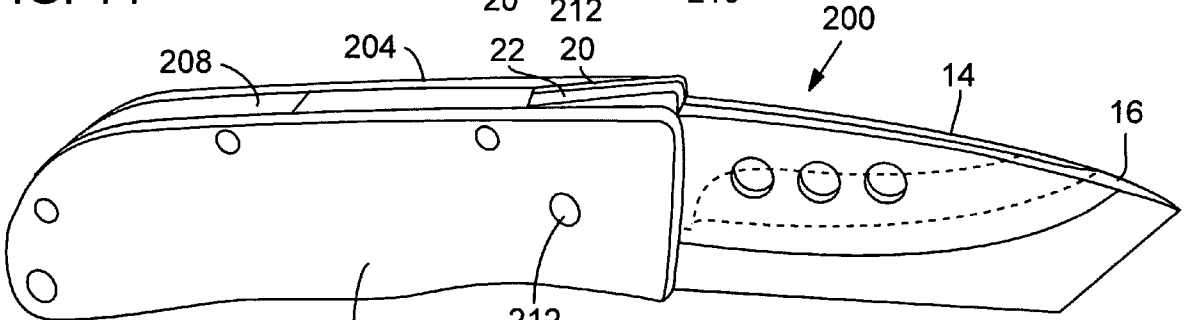
FIG. 15 is a perspective view of the folding knife shown in FIG. 13, as viewed from the opposite side of the knife.

FIGS. 13-15 show a folding knife 200 according to another embodiment. This embodiment shares many similarities with the embodiment of FIGS. 1-12. Hence, the components in FIGS. 13-15 that are identical to corresponding components in FIGS. 1-12 have the same respective reference numerals and are not described further.

The knife 200 comprises a handle portion, or handle, 202 and first and second blades, 14 and 16 respectively, each pivotally coupled to the handle portion 210 in a suitable manner for pivoting about a common pivot axis between respective folded, closed positions (not shown) in which each blade 14, 16 is at least partially received in the handle portion 202 and respective open or use positions (FIGS. 13-15).

The handle portion 202 in the illustrated embodiment comprises first and second side panels 204 and 206 respectively, connected to tang portions 20 and 22 of the blades 14 and 16, respectively by a pivot 212. A spacer 208 can be disposed between side panels 204, 206, defining a blade receiving channel for receiving at least portions of the blades 14, 16 when pivoted to their closed positions.

A portion of the side panel 204 comprises a resilient locking arm 210 which is biased toward the tang portions 20 and 22 of the blades 14 and 16 respectively and which otherwise operates in a similar fashion to the locking arm 56 described above. In an alternative embodiment (not shown), the handle portion 202 can comprises a liner lock disposed between side panels 204 and 206 comprising a resilient locking arm which otherwise operates in a similar fashion to the locking arm 56 described above.

In another embodiment (not shown), the handle portion 202 can include a slidable locking arm (also known as a sliding locking bar) which may be slid laterally between the two side panels 204 and 206. In such an embodiment, the sliding locking bar may be configured to be engageable with either the first blade 14 or the second blade 16 individually, as well as with both.

The handle portion 202 can be held together in a conventional manner, such as by screws extending through side panels 204, 206 and spacer 208. An optional clip 220 can be secured to the side panel by screws.

Figure 16:
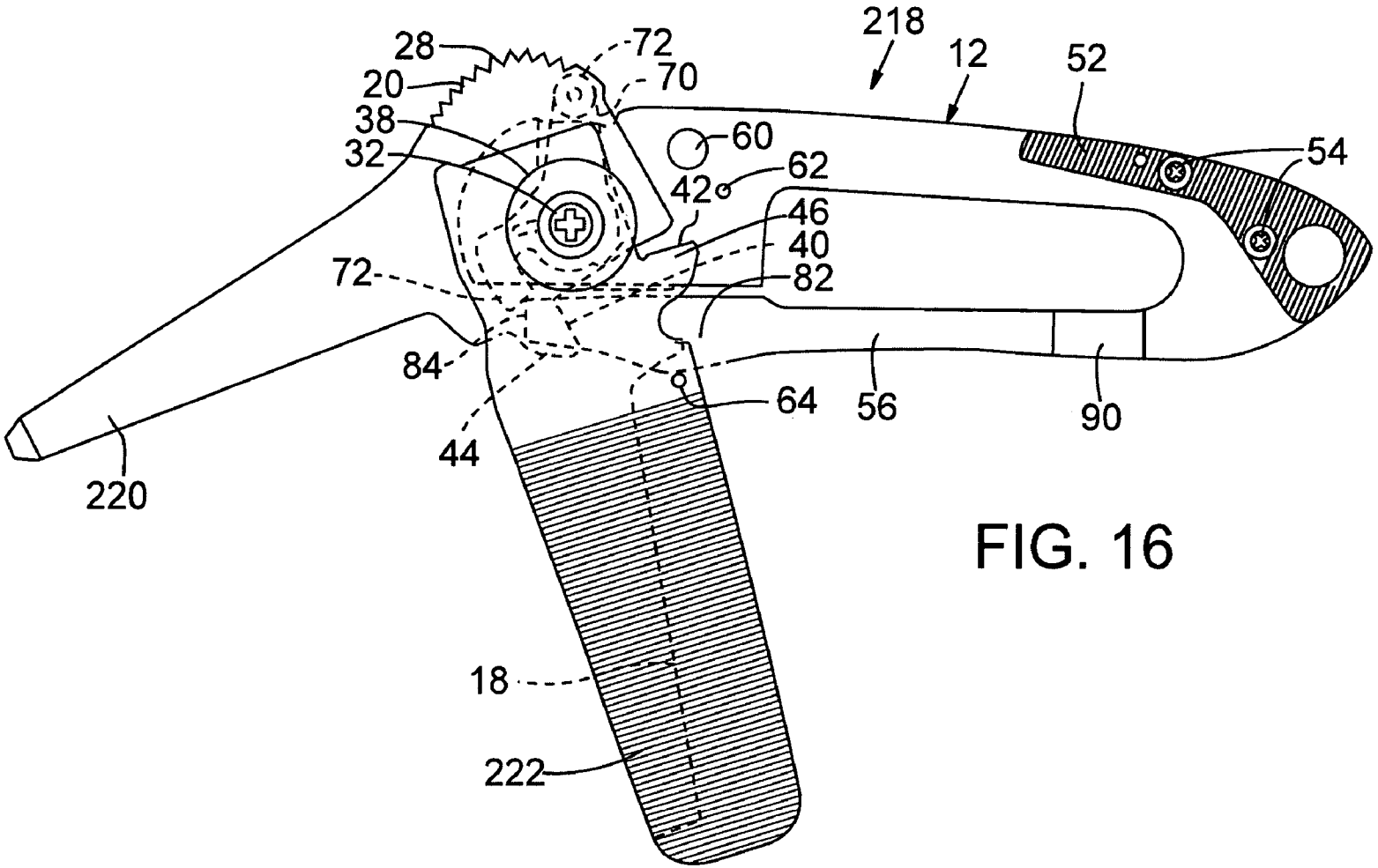
FIG. 16 is a side elevation view of an exemplary folding tool comprising a foldable screwdriver and file.

FIG. 16 shows a folding tool 218, according to an exemplary embodiment. This embodiment shares many similarities with the embodiment of FIGS. 1-12. Hence, the components in FIG. 16 that are identical to corresponding components in FIGS. 1-12 have the same respective reference numerals and are not described further.

The folding tool 218 in the illustrated configuration includes a screwdriver 220 and a file 222, both of which are pivotally coupled to a handle portion 12. The file 222 is formed with a notch or recess 18 that is sized and shaped to at least partially receive the screwdriver 220. The folding tool 218 operates in a similar fashion to the folding knife 10 described above, with the exception that the screwdriver 220 and the file 222 can be used for different purposes than the knife blades 14, 16.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as our invention all that comes within the scope and spirit of these claims.

I claim:

1. A folding knife comprising:

a handle portion;

a first blade pivotally coupled to the handle portion and being operable to pivot between an open position and a closed position about a pivot axis; and a second blade pivotally coupled to the handle portion and being operable to pivot between an open position and a closed position about said pivot axis;

wherein the first and second blades define a common plane in which both blades can pivot independently of each other; and wherein the first blade comprises a cutting edge extending along a length of the blade and a notch extending along a length of the blade opposite the cutting edge, and wherein at least a portion of the second blade is configured to nest within the notch when both blades are in their respective open or closed positions.

2. The folding knife of claim 1, wherein the notch is open to a side surface of the first blade and the second blade has a side surface that is substantially coplanar to the side surface of the first blade when the at least a portion of the second blade is nested within the notch.

3. A folding tool comprising:

a handle portion;

at least first and second tool portions pivotally coupled to the handle portion and each being operable to pivot independently relative to each other and to the handle portion between a respective open position and a respective closed position; and a lock mechanism comprising a resilient locking arm that is movable between a locked position and an unlocked position, wherein when the locking arm is in the locked position and the first and second tool portions are in their respective open positions, the locking arm prevents pivoting of both tool portions from their respective open positions to their respective closed positions and wherein when the locking arm is moved to the unlocked position, both tool portions can be pivoted from their respective open positions to their respective closed positions;

wherein the first and second tool portions comprise first and second blades, wherein the first blade is formed with a recess that is sized and shaped to receive the second blade when both blades are in the open position.

4. The folding tool of claim 3, wherein the locking arm is movable between the unlocked position and first and second locked positions, wherein when the locking arm is in the first locked position, the locking arm prevents pivoting of both blades from their respective open positions to their respective closed positions, wherein when the locking arm is moved to the second locked position, the first blade can be pivoted from its respective open position to its respective closed position while the locking arm prevents pivoting of the second blade from its respective open position to its respective closed position.

5. The folding tool of claim 4, further comprising a safety mechanism that is moveable between a release position and a safety position, wherein when the safety mechanism is in the safety position and the locking arm is in the first locked position, the safety mechanism blocks the locking arm from being moved away from the first locked position, and wherein when the safety mechanism is in the release position, the locking arm can be moved away from the first locked position to permit pivoting of the blades.

6. A folding knife comprising:

a handle portion;

a first blade comprising a cutting edge and being pivotally coupled to the handle portion and operable to pivot relative to the handle portion between an open position and a closed position; and a second blade comprising a cutting edge and being pivotally coupled to the handle portion and operable to pivot relative to the handle portion between an open position and a closed position;

wherein the first and the second blades are configured to prevent the cutting edge of the first blade from pivoting past the cutting edge of the second blade, and wherein the first blade is configured to shield the cutting edge of the second blade from engaging material being cut by the cutting edge of the first blade when both blades are in their respective open positions;

wherein the first blade comprises a notch extending along a length of the blade opposite its cutting edge, and wherein the cutting edge of the second blade is configured to nest within the notch when both blades are in their respective open or closed positions.

7. A folding knife comprising:

a handle portion;

a first blade pivotally coupled to the handle portion and being operable to pivot between an open position and a closed position about a pivot axis; and a second blade pivotally coupled to the handle portion and being operable to pivot between an open position and a closed position about said pivot axis;

wherein the first and second blades define a common plane in which both blades can pivot independently of each other, the common plane intersecting the first and second blades at a position that is intermediate the sides of the first blade and intermediate the sides of the second blade;

wherein the first blade defines a three-dimensional space within which the first blade can pivot between its respective open and closed positions;

wherein the three-dimensional space has a thickness equal to the maximum thickness of the first blade, and the second blade pivots completely within the three-dimensional space of the first blade.

8. A folding tool comprising:

a handle portion;

at least first and second tool elements pivotally coupled to the handle portion and each being operable to pivot relative to the handle portion between a respective open position and a respective closed position, wherein the first tool element is formed with a recess that is sized and shaped to at least partially receive the second tool element when both tool elements are in their respective open and closed positions; and a locking mechanism configured to selectively lock the first and second tool elements in their open positions;

wherein the locking mechanism comprises a single locking element moveable to plural locking positions, wherein when the locking element is in a first locking position, the locking element locks both tool elements in their respective open positions and when the first tool element is in its closed position and the locking element is in a second locking position, spaced from the first locking position, the locking element locks the second tool element in its respective open position, wherein the locking mechanism has a free end portion for locking the first and second tool elements; and wherein the free end portion is flexible relative to the handle portion in a direction that is generally parallel to a pivot axis of the tool elements.

9. The folding tool of claim 8, wherein the locking element is movable to the plural locking positions in a direction that is generally parallel to a pivot axis of the tool elements.

10. A folding tool comprising:

a handle portion;

at least first and second tool elements pivotally coupled to the handle portion and each being operable to pivot relative to the handle portion between a respective open position and a respective closed position, wherein the first tool element is formed with a recess that is sized and shaped to at least partially receive the second tool element when both tool elements are in their respective open and closed positions; and a locking mechanism configured to selectively lock the first and second tool elements in their open positions;

wherein the locking mechanism comprises a resilient, flexible locking arm extending longitudinally of the handle portion, wherein the locking arm has a free end portion that is configured to lock the tool elements by engaging respective end surfaces of the tool elements in a locked position to prevent pivoting thereof and the free end portion of the locking arm is flexible laterally relative to the handle portion to an unlocked position to release the free end portion of the locking arm from engagement with the tool elements to permit pivoting thereof;

wherein the free end portion of the locking arm is flexible relative to the handle portion in a direction that is generally parallel to a pivot axis of the tool elements.

11. The tool of claim 10, wherein the free end portion of the locking arm is flexible laterally relative to the handle portion to an intermediate position between the locked and unlocked positions to release the locking arm from engagement with the first tool element to permit the pivoting thereof while remaining engaged to the respective end surface of the second tool element to prevent the pivoting thereof.

12. The tool of claim 11, wherein the locking arm is resiliently biased toward the locked position.

13. The tool of claim 10, further comprising a safety mechanism configured to prevent the locking arm from being moved to the unlocked position, thereby protecting against inadvertent closure of the tool elements.

14. The tool of claim 13, wherein the tool elements pivot about a common pivot axis and the safety mechanism is configured to pivot about the pivot axis between a safety position and a release position in which the locking arm can move to the unlocked position.

15. The tool of claim 10, wherein the locking arm comprises a user-engageable portion on which a user can apply a lateral force to move the locking arm to the unlocked position.

16. A folding knife comprising:

a handle portion;

a first blade pivotally coupled to the handle portion and being operable to pivot between an open position and a closed position about a pivot axis;

a second blade pivotally coupled to the handle portion and being operable to pivot between an open position and a closed position about said pivot axis, wherein the first and second blades define a common plane in which both blades can pivot independently of each other;

a resilient locking bar that is moveable laterally of the handle between first and second locked positions and an unlocked position, wherein when both blades are in their respective open positions, the locking bar moves to the first locked position and contacts respective end surfaces of the blades to prevent pivoting of the blades to their respective closed position, wherein when the locking bar is moved to the second locked position, the first blade can be pivoted to its respective closed position wherein the locking bar is held in the second locked position by the first blade and contacts the respective end surface of the second blade to prevent pivoting of the second blade to its respective closed position, and wherein when the locking bar is moved to the unlocked position, both blades can be pivoted to their respective closed positions; and a safety mechanism coupled to the handle and being moveable between a safety position and a release position, wherein when the safety mechanism is moved to the safety position and the locking bar in is in the first locked position, the safety mechanism prevents the locking bar from being to the unlocked position, wherein the resilient locking bar has a free end portion for locking the first and second blades; and wherein the free end portion is flexible relative to the handle portion in a direction that is generally parallel to a pivot axis of the first and second blades.

17. The folding knife of claim 16, wherein the safety mechanism is pivotable about the pivot axis between the safety position and the release position.

18. The folding knife of claim 16, wherein the safety mechanism is biased toward the safety position.

* * * * *